US006003758A

United States Patent [19]

Mattia et al.

[11] Patent Number: 6,003,758

[45] Date of Patent: Dec. 21, 1999

[54] MULTIPLE POCKET ENVELOPE

[75] Inventors: James A. Mattia, Harpers Ferry, W. Va.; Robert W. Rudderow, Jr., Davidsonville, Md.

[73] Assignee: Webcraft Technologies, Inc., Horsham, Pa.

[21] Appl. No.: 09/005,842

[22] Filed: Jan. 12, 1998

[51] Int. Cl.[6] ..... B65D 27/08

[52] U.S. Cl. ..... 229/72

[58] Field of Search ..... 229/72, 304, 305

[56] References Cited

U.S. PATENT DOCUMENTS

| | | | |
|---|---|---|---|
| 488,005 | 12/1892 | Griffith . | |
| 895,940 | 8/1908 | Ballard . | |
| 1,035,284 | 8/1912 | Weishampel . | |
| 1,276,101 | 8/1918 | Oakley . | |
| 2,268,795 | 1/1942 | Berkowitz . | |
| 3,116,010 | 12/1963 | Stevenson | 229/72 |
| 3,140,817 | 7/1964 | Fitzgerald | 229/72 |
| 3,420,432 | 1/1969 | Cooper . | |
| 3,482,764 | 12/1969 | Aliff, Jr. et al. . | |
| 3,833,167 | 9/1974 | Kapitan | 229/305 X |
| 3,944,132 | 3/1976 | Caprile et al. . | |
| 4,129,214 | 12/1978 | Gendron | 229/72 X |
| 4,149,667 | 4/1979 | Riley . | |
| 4,204,600 | 5/1980 | Pritchard . | |
| 5,102,234 | 4/1992 | Levy . | |
| 5,397,052 | 3/1995 | Walz . | |

FOREIGN PATENT DOCUMENTS

| | | | |
|---|---|---|---|
| 1053163 | 9/1953 | France . | |
| 2 435 401 | 7/1978 | France . | |
| 2 603 394 | 3/1986 | France . | |
| 9305507 | 7/1993 | Germany . | |
| 430412 | 8/1967 | Switzerland | 229/72 |
| 431 372 | 2/1997 | Switzerland . | |
| 1149044 | 4/1969 | United Kingdom . | |

OTHER PUBLICATIONS

International Search Report in PCT/US99/00660, dated Apr. 21, 1999.

*Primary Examiner*—Jes F. Pascua

*Attorney, Agent, or Firm*—Hugh A. Abrams; Sidley & Austin

[57] ABSTRACT

A dual pocket envelope according to the present invention includes a first blank having first, second and third panels, a fourth panel is glued in an overlying relation to the second panel along a generally U-shaped adhesive line to form a first pocket. The third panel is folded over the fourth panel and glued to the panel along respective side edges to provide a second pocket. The first panel includes a closure flap with adhesive coating. Each of the openings of the first and second pockets are disposed in a staggered or cascade relation so that when the closure flap is folded onto the pocket openings, the adhesive separately seals each of the pockets.

12 Claims, 4 Drawing Sheets

MULTIPLE POCKET ENVELOPE

FIELD OF THE INVENTION

The present invention relates to envelopes and more particularly to envelopes having at least two pockets, each pocket being adapted to be opened independently while leaving the other sealed.

BACKGROUND OF THE INVENTION

Multiple pocket envelopes are used by mailers who wish to physically separate two or more items being sent to a recipient in a single envelope.

Businesses or governmental agencies often provide mailer envelopes for persons sending documents to the agency, some of which are of a sensitive nature or otherwise not intended to be handled by certain clerical staff within the agency. For example, federal and state tax returns contain highly confidential information and are often mailed to the agency together with a check or other bank draft. As is apparent, it is desirable to separate the bank draft from the tax return within the envelope. Accordingly, envelopes having multiple pockets or compartments adapted to be separately opened have been developed. Such envelopes enable a first clerk to remove the tax return from the envelope while the second clerk will subsequently open a separate interior pocket and remove the bank draft.

Envelopes having multiple pockets have long existed in the prior art. For example, U.S. Pat. No. 2,268,795 to Berkowitz discloses a money compartment envelope formed from a blank having numerous flaps adapted to fold inwardly to provide a first pocket having a smaller second pocket formed by gluing a blank to the interior of the first pocket. Even though dual pockets are provided, they cannot be opened independent of each other since tearing at the top of the envelope results in simultaneously opening of both pockets. This is undesirable. Further, this mailer does not stagger or offset the openings to each pocket and therefore it becomes difficult for the user to separately place materials into each pocket prior to sealing of the envelope. In addition, the numerous side flaps and glue lines on the blank do not promote efficient assembly of the envelope.

Another problem with prior art multiple pocket envelopes is the damage that occurs to the envelope when one of the pockets is opened whereby the partially opened envelope is so mangled that it is often difficult to efficiently pass it on to a second operator for subsequent opening, either manually or by way of machinery.

Finally, prior art multiple pocket envelopes cannot be assembled from a single uniform blank. Prior art envelopes require complicated cutting, gluing and manifolding operations that are inefficient and not cost effective in today's commercial environment.

In view of the above, the present invention was developed for purposes of providing enhanced security for a multiple pocket envelope and improved manufacture of the same.

OBJECTS AND SUMMARY OF THE INVENTION

The present invention is directed to a dual pocket envelope that will avoid the above discussed problems by providing a multiple pocket envelope formed from a single, readily handled uniform blank, the envelope having at least two pockets that may be opened independent of the remaining pockets within the envelope without destruction of the overall integrity of the envelope.

A further object of the present invention is to provide a mailer envelope having staggered openings that will permit easy access to each individual pocket.

Yet another object of the present invention is to provide an envelope that does not require side flaps, complicated folds nor complex glue lines.

Yet another object of the present invention is to provide a dual pocket mailing envelope having a first pocket adapted to be opened from the bottom of the envelope and a second pocket adapted to be opened from the top of the envelope, opening of each respective pocket will not result in opening or compromise of the security of the other remaining pockets.

A dual pocket envelope according to the present invention includes a first blank having first, second and third panels, a fourth panel is glued in an overlying relation to the second panel along a generally U-shaped line to form a first pocket. The third panel is folded over the fourth panel and glued together along respective side edges to provide a second pocket. The first panel includes an adhesive coating. Each of the openings of the first and second pockets are disposed in a staggered relation so that when the first panel is folded onto the pocket openings, the adhesive will seal each of the pocket separately.

The present invention is directed to a multiple pocket envelope comprising a front panel and a back panel hingedly connected along respective bottom edges and sealed along respective side edges, a cover flap hingedly connected to the back panel along a top edge thereof and being adapted to be folded over a top edge of the front panel and at least a portion thereof adapted to be secured to a surface of the front panel and, at least one intermediate panel disposed between the front panel and the back panel to provide first and second envelope pockets, the at least one intermediate panel is secured along respective side edges and a bottom edge to the back panel to provide respective pocket openings, the at least one intermediate panel having a top portion extending beyond the front panel top edge, at least a portion of the cover flap is adapted to be secured to a surface of the top portion to seal the first pocket from the second pocket.

The present invention is also directed to a blank for forming a multiple compartment envelope, the blank comprising a rectangular panel having a first portion, a second portion and third portion, a first fold line disposed between the first and second portions, a second fold line disposed between the second and third portions, a first glue line disposed adjacent two outer edges of the second portion and adjacent the first fold line, the first glue line adapted to secure a panel thereto for forming a first pocket with the second portion, second and third glue lines disposed along respective outer edges of the first portion for securing the first portion onto the panel when the first portion is folded along the first fold line to form a second pocket with the panel, and, a fourth glue line disposed on the third portion for securing the third portion onto the first portion when the third portion is folded along the second fold line.

The present invention is also directed to a method for making a multiple pocket envelope, the method comprising the steps of providing a rectangular panel having a first portion, a second portion and third portion, forming a first fold line on the panel, the first fold line disposed between the first and second portions, forming a second fold line on the panel, the second fold line disposed between the second and third portions, applying a first glue line adjacent two outer edges of the second portion and adjacent the first fold line, securing a panel to the first glue line to form a first pocket with the second portion, applying second and third glue lines along respective outer edges of the first portion, folding the first portion along the first fold line and securing the first portion onto the panel to form a second pocket with the panel, and, applying a fourth glue line on the third portion for securing the third portion onto the first portion when the third portion is folded along the second fold line.

These and other objects of the present invention will become apparent from the following drawings and detailed specification taken together with the representative examples.

DETAILED DESCRIPTION OF THE PREFERRED EMBODIMENTS

Figure 1:
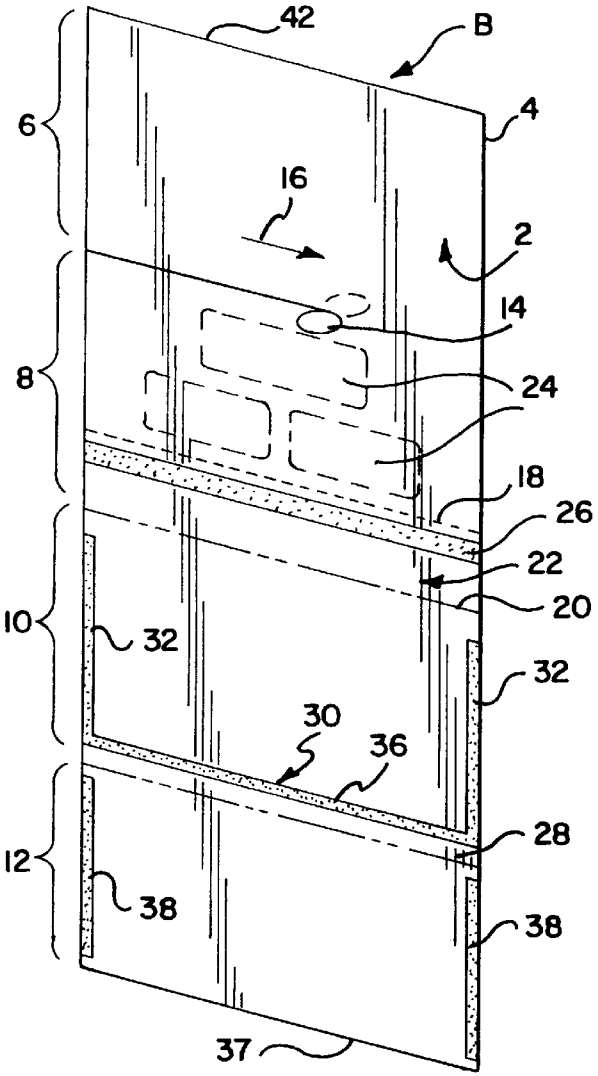

FIG. 1 is an elevational view of a generally rectangular blank B of uniform shape including a rectangular front panel 2 and matching rear panel 4. As is apparent, it is within the scope of the present invention to provide other uniform shapes depending upon the commercial requirements of the envelope. The blank B includes four panels or sections; namely, first panel 6, second panel 8, third panel 10, and fourth panel 12. The panels are approximately the same size and as noted above, may be varied in size depending upon the end use of the envelope. For example, it may be desirable to increase the size of a panel to provide for accommodation of labels or the like. In at least one embodiment, one of the panels may be omitted or considerably reduced in size, as will be further explained below.

As shown in FIG. 1, first panel 6 may be formed by cutting an end portion of the blank B using a cutter 14 moving in the direction of arrow 16 thereby forming a top edge 42 and bottom edge 43. In the alternative (not shown), first panel 6 may be provided as a separate, pre-cut blank. In that embodiment, blank B may be reduced in length as appropriate.

Second panel 8 includes a fold line 20 and perforated line 18, each of which extends across Blank B, the perforated line 18 is adapted to permit a portion of the panel to be removed from the blank B, leaving envelope flap 22 remaining. Second panel 8 may include removable mailing labels 24 positioned on the rear of the panel. As is apparent, second panel 8 may be formed without perforated line 18 and instead formed as a single flap 22 having a size and dimension as required.

An adhesive coating 26 is applied to second panel 8, the adhesive extends along the width of the panel for purposes of permitting envelope flap 22 to be adhered to the body of the envelope in a manner as will be further explained below.

A third panel 10 extends beneath fold line 20 and a fold line 28 and includes an adhesive coating 30 extending along the side edges 32 of panel 10 and adjacent fold line 28. The adhesive coating 30 is shown to provide a coating of adhesive extending substantially along three edges of the front of third panel 10. It is within the scope of the present invention to vary the size of third panel 10 depending upon the size requirements of the end product envelope.

A fourth panel 12 extends from fold line 28 to a bottom edge 37 and is provided with an adhesive coating 38 extending along each side edge of the front of panel 12. Both the size of panel 6 and the size of panel 12 are selected to provide pockets having staggered openings for placing materials within the pockets.

Figure 2:
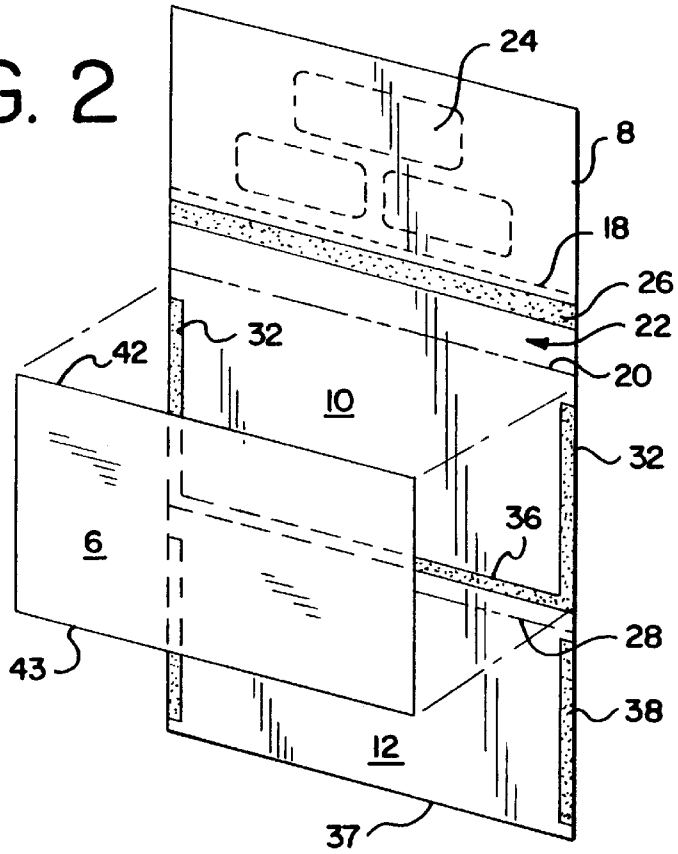
FIGS. 1, 2, 3A, 3B and 4 illustrate the method of constructing the envelope according to the present invention from a blank.

Turning to FIG. 2, a first pocket 46 is formed by positioning the first panel 6 (previously removed from blank B or provided as a separate blank) onto the third panel 10 so that the underside of the first panel is secured at adhesive coating 30 to the front of third panel 10. The opening of first pocket 46 is adjacent top edge 42.

Figure 3A:
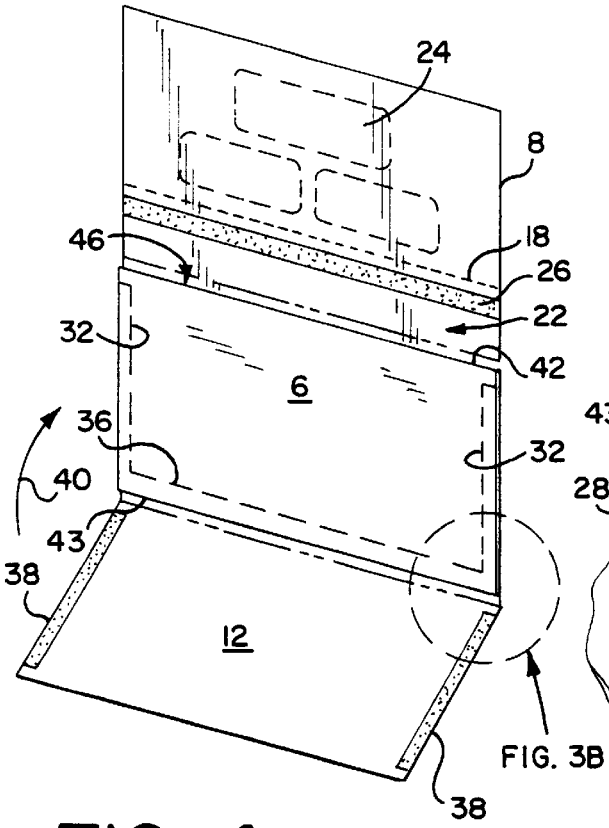
Figure 3B:
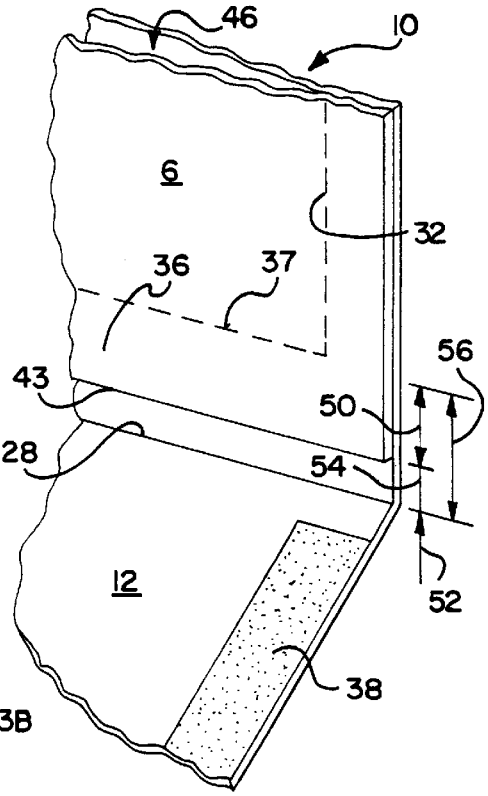

FIG. 3B illustrates in greater detail the positioning of the first panel 6 onto the third panel 10 and in particular the positioning of the bottom edge 43 of first panel 6 with respect to the fold line 28. Arrows 50 and 52 define a distance 54 extending from the bottom edge 43 of panel 6 and fold line 28. In a preferred embodiment, distance 54 is about ⅛th inch with arrow 56 defining the distance from the bottom 37 of pocket 46 to the fold line 28. As is apparent, distance 56 may be modified depending upon end use of the envelope, however, in the preferred embodiment the top edge 37 of adhesive line 36 (which defines the bottom of the first pocket 46) is sufficiently distanced from fold line 28 whereby opening of the second pocket (not shown, but formed by adhering panel 12 to panel 6) will not likewise open first pocket 46.

Figure 4:
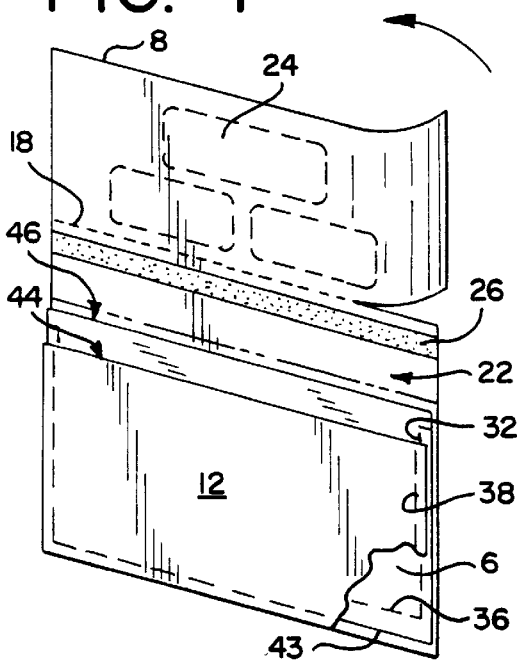

Returning to FIG. 3A, formation of a second pocket is shown wherein fourth panel 12 is folded about fold line 28 and in the direction of arrow 40 to bring adhesive coatings 38 into contact with panel 6 and in the manner as shown in FIG. 4 providing a second pocket 44. As best shown in FIG. 4, the optional label portion of second panel 8 may be removed from the remainder of panel 8 by tearing along perforated line 18 leaving envelope flap 22 remaining.

Each of first pocket 46 and second pocket 44 includes a separate opening positioned in a staggered or offset relation. The positioning in an overlapping manner of second panel top edge 42 and fourth panel bottom edge 37 provides the staggered relation of the respective pocket openings and also functions to seal the respective pockets in a novel manner as will be further explained below.

Figure 5:
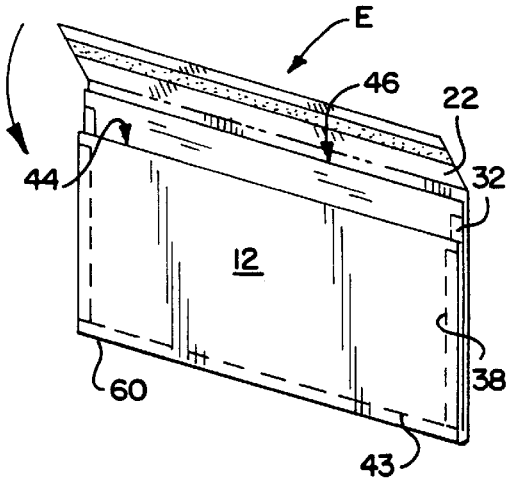
FIGS. 5 illustrates the finished envelope prior to closure of the flap.
Figure 6A:
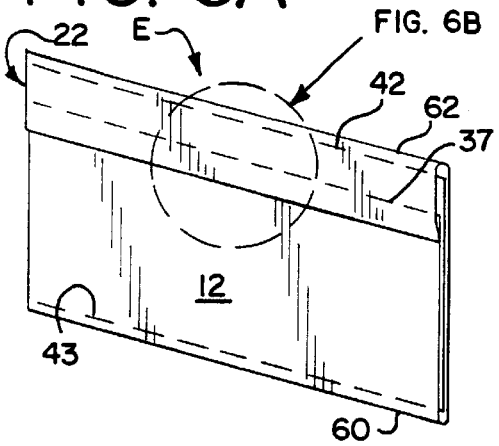
FIGS. 6A and 6B illustrates the finished envelope with the flap in a sealed position and having portions broken away therefrom.

FIG. 5 illustrates the manner of closing the envelope flap 22 in the direction of the arrow and towards the folded fourth panel 12 so that the adhesive coating 26 on flap 22 is brought into contact with the panel surface and the envelope is closed in the manner of FIG. 6.

Figure 6B:
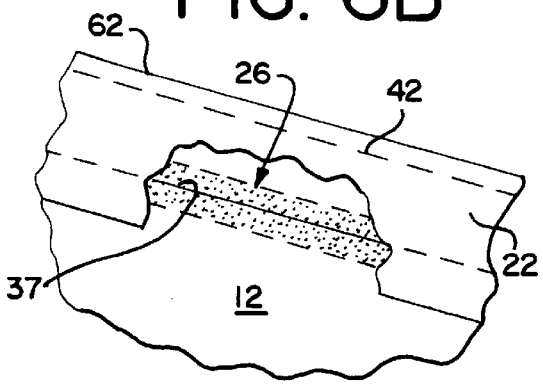
Figure 13:
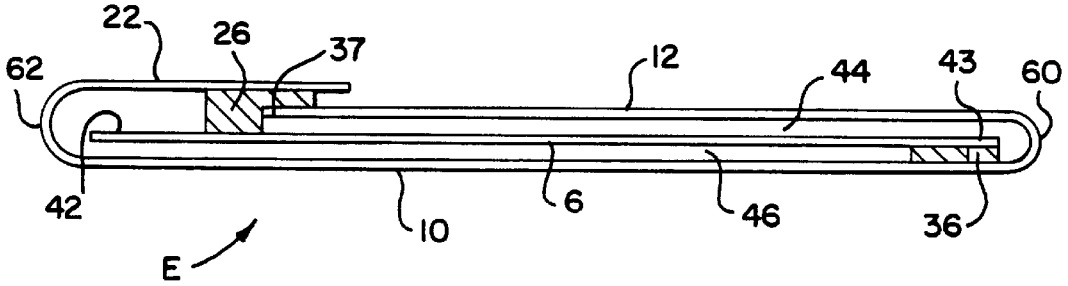
FIG. 13 is a cross sectional view of the envelope taken along lines 13—13 of FIG. 6.

FIGS. 6B and 13 illustrate in greater detail the disposition of adhesive 26 such that flap 22 is caused to be adhered against both the exterior surface of fourth panel 12 and first panel 6. This arrangement provides first and second pockets that cannot be simultaneously opened at either the top or bottom ends of the envelope and therefore will provide enhanced security for the documents or other papers within the pockets. More particularly and as best shown in FIG. 13, if a cut or tear is made along sealed envelope end 60, the second pocket 44 is readily opened without opening first pocket 46 by virtue of adhesive lines 36 and 26. Conversely, if a cut or tear is made along sealed envelope end 62, the first pocket 46 caused to be opened in a manner independent of the second pocket. In the disclosed arrangement, simultaneously opening of the pockets is prevented if a cut is made at either of the envelope ends. As is apparent, it is within the scope of the present invention to extend or shorten the relative widths of the adhesive glue lines 26 and 36 for a particular application. It is within the scope of the present invention to provide a continuous layer of adhesive in the manner shown in the figures, a discontinuous layer, discrete separate layers or other arrangement so long as the edges 37 and 42 are both caused to be sealed. For example, a first adhesive layer could be provided to adhere the flap 22 to the bottom edge 37, the bottom edge 37 having perforations therethrough to permit the adhesive 26 to also contact and cause to be sealed the first panel lying thereunder.

As is apparent, it is within the scope of the present invention to provide additional pockets as required by providing additional panels in a superimposed manner and gluing the same in an overlapping or otherwise aligned relation.

Figure 7:
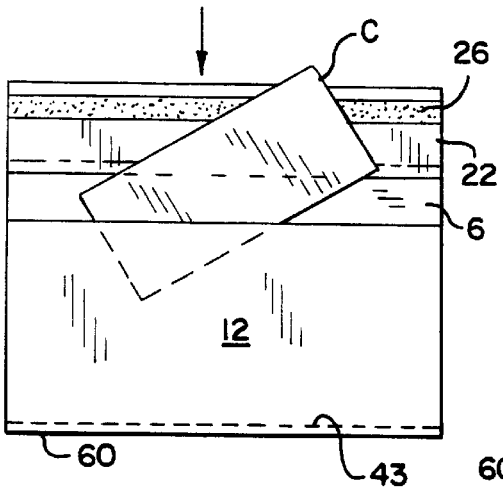
FIG. 7 through 12 illustrate placement and removal of material from the pockets of the envelope according to the present invention.
Figure 8:
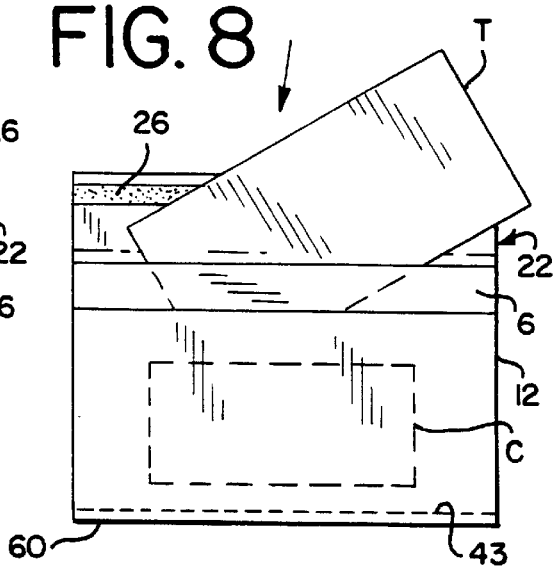

Turning to FIGS. 7 through 12, the envelope E according to the present invention is shown in use. As best shown in FIG. 7, a check C or other paper is placed within pocket 44. FIG. 8 illustrates a document T or other paper being placed within separate pocket 46 after which the envelope flap 22 may be secured to the fourth panel in the manner as set forth above.

Figure 9:
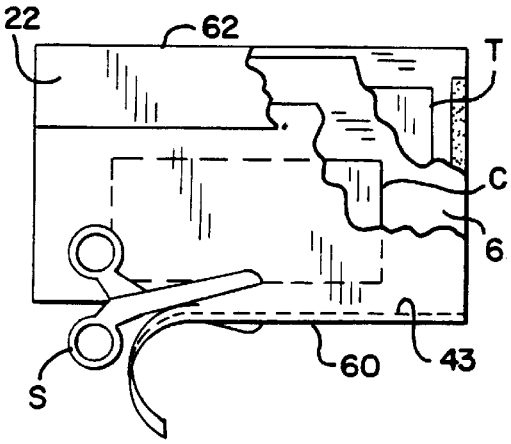
Figure 10:
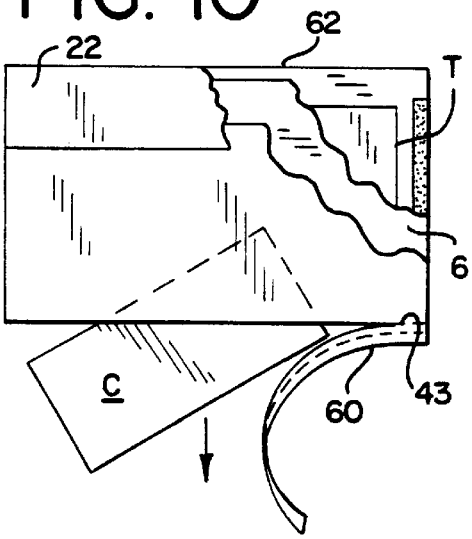
Figure 11:
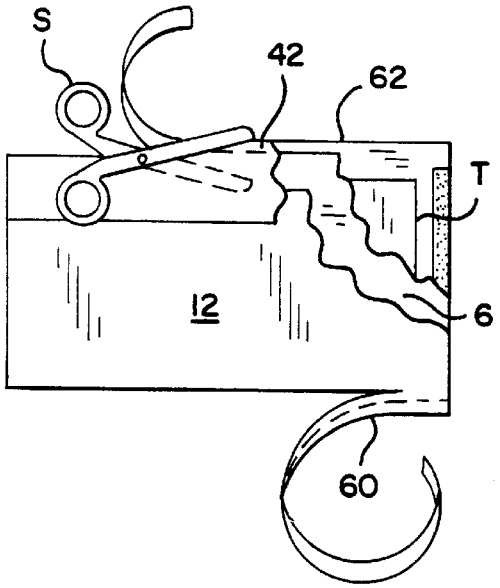
Figure 12:
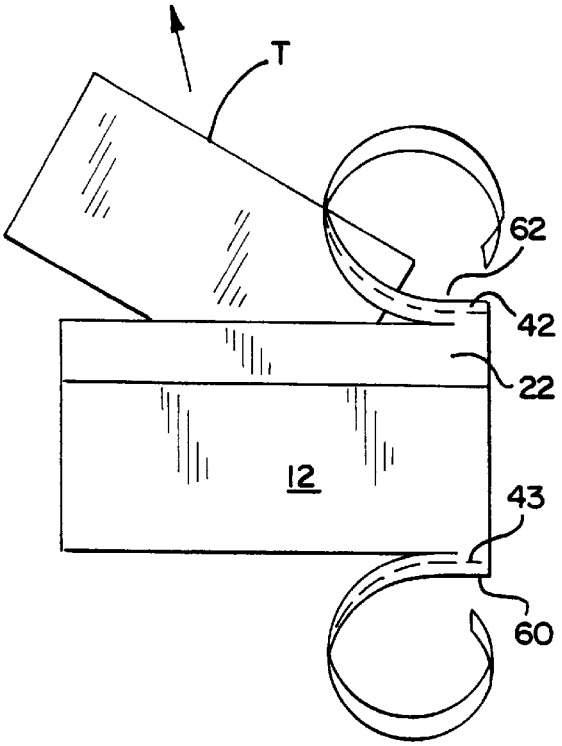

Turning now to FIG. 9, the envelope E including pockets containing check C and tax return T may be opened by cutting using scissors S or other device along envelope bottom end 60 adjacent bottom edge 37 of panel 2. This opening of pocket 44 permits check C to be removed from the pocket as shown in FIG. 10, while at the same time leaving pocket 46 secure and intact by virtue of adhesive line 36 at the bottom of the envelope and adhesive line 26 at the top of the envelope. The envelope may then be passed to a second operator or machine where, as shown in FIG. 11, scissors S or other cutting device will cause a cut to be made along the top end 62 whereby pocket 46 is caused to be separately opened and document T removed.

As is apparent, the blank as shown in FIG. 1 may be readily formed using conventional manifolding and cutting machinery in the paper handling industry without the need for extensive side flaps, excess waste of material or repeated positioning of the blank during formation of the envelope. The single uniform single blank B may be cut, scored, coated with adhesive and formed into the finished envelope shown in FIG. 5 in an efficient manner. The adhesive lines applied adjacent the fold lines and along the edges of the envelopes and the panels permit the envelope to be assembled in an efficient manner.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

We claim:

1. A multiple pocket envelope comprising:

a) a front panel and a back panel hingedly connected along respective bottom edges and sealed along respective side edges;

b) a cover flap hingedly connected to said back panel along a top edge thereof and being adapted to be folded over a top edge of said front panel and at least a portion of said cover flap being adapted to be secured to a surface of a top portion said front panel; and, c) at least one intermediate panel disposed between said front panel and said back panel to provide a first envelope pocket between said at least one intermediate panel and said back panel and a second envelope pocket between said front panel and said at least one intermediate panel, said at least one intermediate panel is secured along respective side edges and a bottom edge to said back panel to provide respective pocket openings, said at least one intermediate panel having a top portion extending beyond said front panel top edge, said portion of said cover flap extending over said top edge of said front panel being adapted to be adhesively secured to a surface of said top portion of said front panel, said front panel adapted to thereby be adhesively secured to said at least one intermediate panel near said top edge of said front panel, to seal said first pocket from said second pockets, said cover flap adapted to be cut open at a top location above said top edge of said front panel to provide access to said first envelope pocket, said back panel adapted to be cut open at a bottom location beneath said bottom edge of said at least one intermediate panel to provide access to said second envelope pocket, with said bottom edge of said intermediate panel being completely spaced apart from said bottom location.

2. A multiple pocket envelope as in claim 1 and further comprising:

a) an adhesive coating provided on said cover flap for securing said flap to said front panel surface and said at least one intermediate panel top portion surface.

3. A multiple pocket envelope as in claim 1 and further comprising:

a) a removable panel coextensive with said cover flap.

4. A multiple pocket envelope as in claim 1 and wherein:

a) said at least one intermediate panel is longer from said bottom edge to said top portion than said front panel from said bottom edge to said top edge.

5. A multiple pocket envelope as in claim 1 and wherein:

a) said at least one intermediate panel top portion extending between said front panel top edge and said back panel top edge.

6. A multiple pocket envelope as in claim 1 and further including:

a) a gap extending between said hinged connection of said front and back panels and said at least one intermediate panel bottom edge.

7. A multiple pocket envelope as in claim 6 and wherein:

a) said intermediate panel has a width defined between said side edges of said intermediate panel, said gap has a width less than the width of said at least one intermediate panel secured bottom edge.

8. A multiple pocket envelope as in claim 6 and wherein:

a) said back panel is adhered to said at least one intermediate panel along said respective side edges.

9. A multiple pocket envelope as in claim 1 and further comprising:

a) said adhesively secured bottom edge of said at least one intermediate panel preventing access to said first envelope pocket when said back panel is cut open at said bottom location.

10. A multiple pocket envelope as in claim 1 and further comprising:

a) said adhesively secured top edge of said front panel preventing access to said second envelope pocket when said cover flap is cut open at said top location.

11. A multiple pocket envelope as in claim 1 and further comprising:

a) said adhesive connection between said front panel and said intermediate panel being separate and apart from said adhesive connection between said cover flap and said front panel.

12. A multiple pocket envelope as in claim 1 and further comprising:

a) said cover flap being adapted to secure said front panel to said intermediate panel.

* * * * *